US005244266A

United States Patent [19]

Maldanis

[11] Patent Number: 5,244,266

[45] Date of Patent: Sep. 14, 1993

[54] CONTROL SYSTEM FOR A MULTIPURPOSE MERCHANDISING MACHINE

[75] Inventor: Algert J. Maldanis, Piscataway, N.J.

[73] Assignee: The C-Power Companies, Rockwall, Tex.

[21] Appl. No.: 863,062

[22] Filed: Apr. 3, 1992

[51] Int. Cl.[5] ..... A47F 3/04

[52] U.S. Cl. ..... 312/116; 312/36

[58] Field of Search ..... 312/97.1, 36, 116, 125; 62/246; 221/9, 155

[56] References Cited

U.S. PATENT DOCUMENTS 2,584,628 2/1952 Skillman ..... 312/36 X
3,129,039 4/1964 Staley ..... 312/97.1
3,627,395 12/1971 Hoey ..... 312/125 X
4,317,604 3/1982 Krakauer .
4,391,388 7/1983 Krakauer .
4,927,051 5/1990 Falk et al. .
5,048,717 9/1991 Falk et al. ..... 221/155 X

*Primary Examiner*—Rodney M. Lindsey
*Attorney, Agent, or Firm*—Finnegan, Henderson, Farabow, Garrett & Dunner

[57] ABSTRACT

A multipurpose, refrigerated food vending machine of the type which includes a rotatable carousel divided into compartments for receiving merchandise to be vended from the machine. A microprocessor controls and tracks various functions in the machine. In particular, the microprocessor is programmed to rotate the carousel through a predetermined increment and at a predetermined time interval to periodically reposition the merchandise disposed in the carousel such that the merchandise is maintained at the average temperature prevailing in the cabinet of the machine.

4 Claims, 3 Drawing Sheets

CONTROL SYSTEM FOR A MULTIPURPOSE MERCHANDISING MACHINE

BACKGROUND OF THE INVENTION

1. Field of the Invention

The present invention relates generally to merchandising machines, and in particular to multipurpose, refrigerated food merchandising machines of the type having a rotatable carousel which is divided into compartments for receiving merchandise to be vended from the machine. Even more particularly, the present invention relates to a control system for controlling the rotation of the carousel within such a machine.

2. Description of the Related Art

Multipurpose, refrigerated merchandising machines of the type which include a rotatable carousel divided into compartments for receiving merchandise to be vended from the machine are well-known in the art. Examples of such machines are disclosed in U.S. Pat. Nos. 4,317,604, 4,391,388, and 4,927,051. Such machines include a generally rectangular cabinet having a front door which can be opened by an operator to service and stock the machine. The front door includes a viewing area for viewing products disposed in the machine. The viewing area may comprise a plurality of transparent windows and a plurality of movable, transparent delivery doors which a customer can open to retrieve a product once sufficient money has been inserted.

These known merchandising machines include a drive mechanism for rotating the carousel, and a refrigeration system for recycling chilled air through the cabinet. These machines also include a microprocessor for controlling and tracking, among other things, movement of the carousel. For instance, in the U.S. Pat. No. '051 there is described a control logic which records and stores information relating to the number of full or empty compartments within the carousel. A predetermined time after a vend, i.e., a purchase by a customer, has occurred from the machine, the carousel is automatically rotated upon instruction from the microprocessor to place that portion of the carousel which contains the greatest number of full compartments in the vicinity immediately adjacent the viewing area. While the purpose of such a control system appears to be an attempt to induce sales from the vending machine by displaying the maximum amount of product possible in the viewing area, such a logic may not accomplish that purpose since it will, in at least some instances, place the least desirable products disposed within the machine in the viewing area, thereby discouraging sales.

Merchandising machines of the type to which the present invention is directed are subject to environmental regulations of local authorities to insure that food vended from the machine remains fresh. Typically, such regulations require that the interior of the cabinet be maintained at about 40° F. However, the refrigeration system in such known carousel-type merchandising machines, since it is based on a forced air distribution system, results in temperature gradients throughout the cabinet. These temperature gradients are created by obstructions to the air flow the position of delivery and air return registers, variances in insulation thickness and efficiency, etc. Thus, certain portions of the interior of the cabinet are warmer than other portions.

Typically, the warmer areas of the cabinet interior are those closest to the viewing area since light fixtures, designed to illuminate the product, warm that portion of the cabinet next to the viewing area. Moreover, when a customer opens a delivery door to retrieve a product, cold air escapes and the warmer ambient air enters the cabinet. In such instances, the dispensable products in those compartments adjacent the viewing area are subjected to warmer temperatures and may spoil before their expiration date.

The merchandiser described in the above-referenced U.S. Pat. No. '051 amplifies this problem since the fullest section of the carousel is usually positioned adjacent the viewing area and remains in that position until additional vends are made from the machine. This causes a significant number of products in the machine to be subjected to higher temperatures for a long enough time to create spoilage. The products stored in the rear section of the machine, on the other hand, may freeze because they are subjected to a continuous flow of refrigerated air unmoderated by the warming influence of the viewing area.

Other known control systems for rotating the carousel of the above-described type of merchandising machine have been programmed to rotate the carousel one full revolution every fixed time interval, such as three minutes, to thereby parade all of the products past the viewing are in the hopes of encouraging impulse sales of those products. However, periodically rotating the carousel one complete revolution does not solve the problem since the carousel is always returned to its original position.

One object of the present invention is to provide an improved control system for a multipurpose, refrigerated merchandising machine.

Another object of the invention is to provide an improved control system for a multipurpose, refrigerated merchandising machine which attracts customers even as the supply of articles in the machine is depleted.

Another object of the present invention is to provide, through periodic rotation of the carousel, improved air circulation and temperature distribution within the cabinet to thereby maintain the products disposed in the machine at the average cabinet temperature.

Additional objects and advantages of the invention will be set forth in the description which follows, and in part will be apparent from the description, or may be learned by practice of the invention. The objects and advantages of the invention may be attained by means of the instrumentalities and combinations particularly pointed out in the appended claims.

SUMMARY OF THE INVENTION

To achieve the foregoing objects, and in accordance with the purposes of the invention as embodied and broadly described herein, a multipurpose, refrigerated merchandising machine is provided, comprising a cabinet having a door defining a front surface of the cabinet. The door includes a viewing area for viewing products disposed in the merchandising machine. A merchandise carousel is rotatably mounted in the cabinet about a vertical axis and the carousel is divided into a plurality of horizontal shelves spaced along the vertical axis. A plurality of dividers are disposed on each of the shelves to define a plurality of compartments on each shelf for receiving merchandise to be dispensed. The dividers and the shelves, in conjunction, define a plurality of vertical columns of compartments around the periphery of the carousel. A driving means for rotating the carousel to bring respective ones of the columns of compartments into alignment with the viewing area is also provided. The machine further includes control means for actuating the drive means to rotate the carousel in a predetermined increment and at a predetermined time interval to periodically change the particular columns of compartments aligned with the viewing area. The predetermined increment is selected independently of the number and location of compartments of the carousel which contain merchandise to be dispensed, and the predetermined time interval is selected such that the merchandise disposed in the compartments of the carousel are maintained at substantially the average temperature prevailing in the cabinet.

BRIEF DESCRIPTION OF THE DRAWINGS

The accompanying drawings, which are incorporated in and constitute a part of the specification, illustrate a presently preferred embodiment of the invention and, together with the general description given above and the detailed description given below, serve to explain the principles of the invention. In the drawings.

DESCRIPTION OF THE PREFERRED EMBODIMENT

Figure 1:
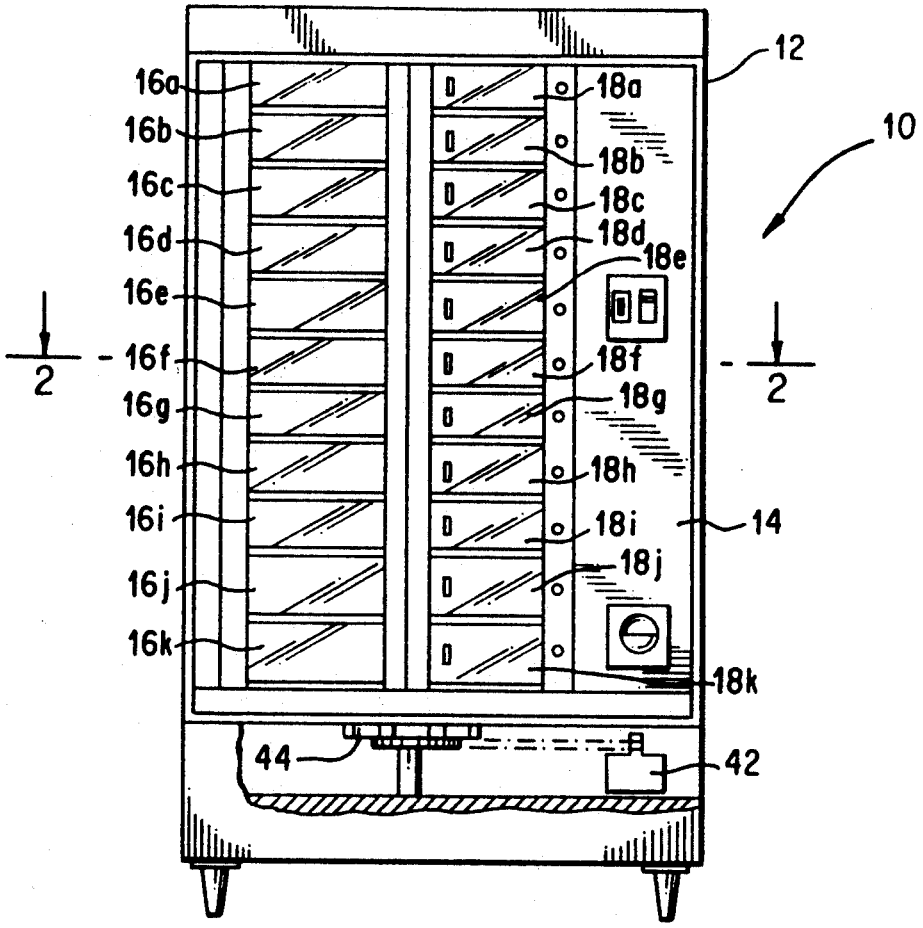
FIG. 1 is a front view of a multipurpose, refrigerated merchandising machine for which the present invention is an improvement.

The present invention is directed to a control system for a multipurpose, refrigerated merchandising machine of the type which includes a rotatable carousel mounted within a cabinet for rotation about a vertical axis. Such a multipurpose, refrigerated merchandising machine is illustrated, by way of example, in FIGS. 1 and 2 and is designated by reference numeral 10. Merchandising machine 10 comprises a cabinet 12 having a door 14 which defines a front surface of the cabinet. Door 14 includes a viewing area for viewing products disposed in the merchandising machine. In the exemplary embodiment of the present invention, the viewing area comprises a plurality of transparent windows 16*a*–16*k* and a corresponding plurality of transparent delivery doors 18*a*–18*k*. Delivery doors 18*a*–18*k* are configured to slide to the right as shown in FIG. 2 to provide access to products disposed in the machine once sufficient money has been inserted. With reference to FIG. 2, merchandising machine 10 includes a merchandise carousel 20 rotatably mounted in cabinet 12 about a vertical axis 22. Carousel 20 includes a hollow central duct 23 for receiving chilled air which is then distributed over the products disposed in the carousel as described below.

Figure 3:
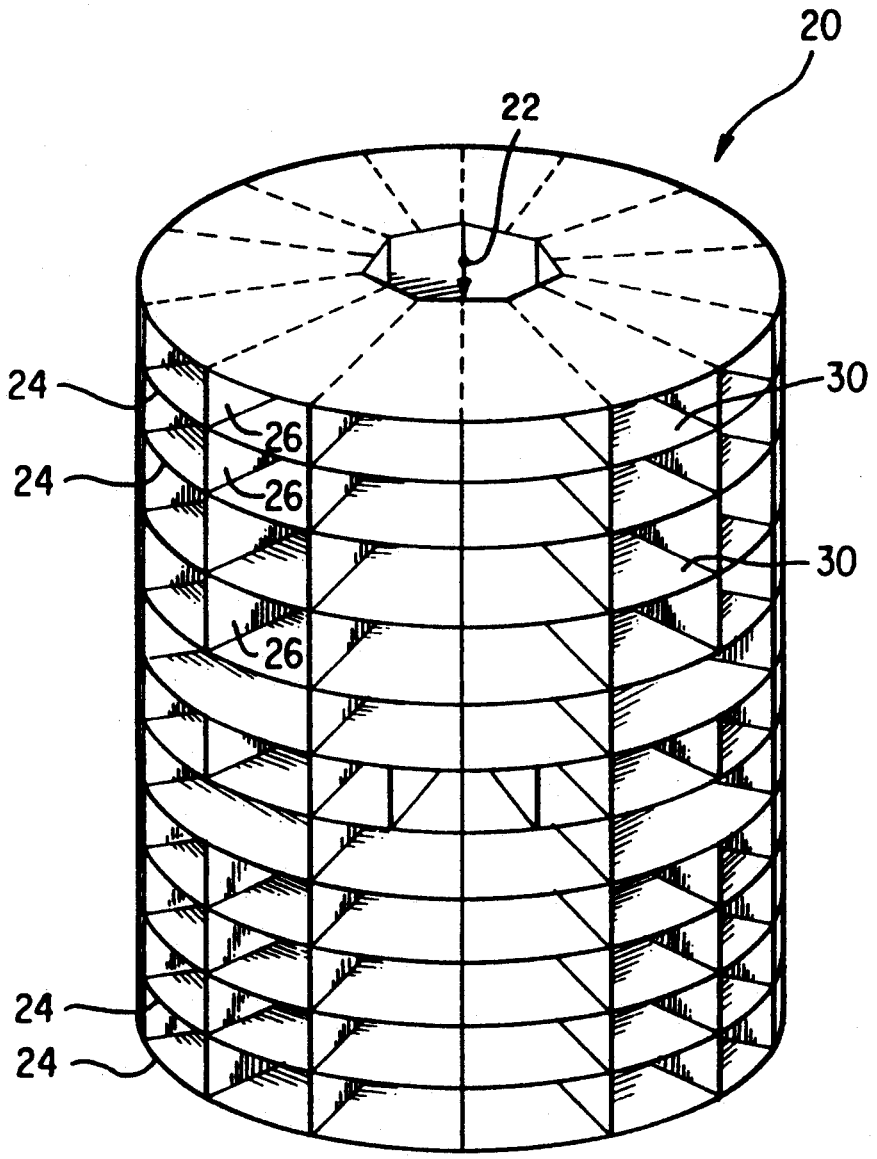
FIG. 3 is an isometric view of the carousel disposed within the multipurpose, refrigerated merchandising machine illustrated in FIGS. 1 and 2.

FIG. 3 is an isometric view of carousel 20. As illustrated, carousel 20 includes a plurality of shelves 24 spaced from one another along vertical axis 22. A plurality of vertically-oriented, radial dividers 26 are disposed on each of shelves 24 to define a plurality of compartments 30 on each shelf. Compartments 30 receive merchandise to be dispensed from the machine and dividers 26, in conjunction with shelves 24, define a plurality of vertical columns of compartments around the periphery of carousel 20. If desired, some or all of compartments may be subdivided into smaller compartments by insertion of an additional divider within a particular compartment. This feature of being able to subdivide particular compartments, thereby affording the operator of the machine greater flexibility in determining the mix of products to be stocked in the machine, is described in the U.S. Pat. No. '604 referenced in the preceding section.

For purposes of describing a preferred embodiment of the present invention, the carousel shown in the drawings is divided into seven large compartments, each of which can be subdivided into two smaller compartments. Thus, the exemplary embodiment of carousel 20 has a maximum of fourteen columns of subdivided, or smaller, compartments around its periphery. Of course, the large compartment may be divided into thirds or fourths, thereby resulting in a greater number of columns of compartments around the periphery of the carousel. Regardless of how many columns of compartments the carousel may be divided into, the drive mechanism for rotating the carousel must be capable of indexing movement of the carousel to allow the carousel to be selectively stopped at a number of positions which is equal to the greatest number of compartments which can be configured on a shelf. For purposes of describing an exemplary embodiment of the present invention, the drive mechanism is presumed to be capable, on selective operator command, of stopping the carousel at any of fourteen different positions in one revolution, and the carousel can be visualized as having fourteen separate columns of compartments about its periphery as shown in FIG. 2.

Figure 2:
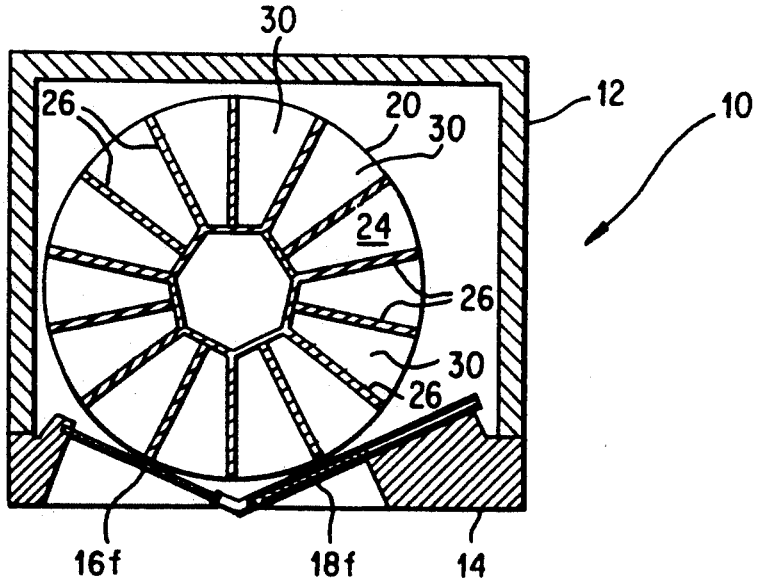
FIG. 2 is a cutaway top view taken along line 2—2 in FIG. 1.

With reference to FIG. 1, merchandising machine 10 includes driving means for rotating the carousel about vertical axis 22 to bring respective ones of the columns of compartments into alignment behind the viewing area comprised of transparent windows 16*a*–16*k* and transparent delivery doors 18*a*–18*k*. As embodied herein, the driving means comprises an electric motor 42 and a gear arrangement 44. Gear arrangement 44 may comprise a Geneva-type gear drive mechanism as described, for example, in the U.S. Pat. No. '604 . However, the particular gear and motor drive arrangement illustrated is not a limiting feature of the present invention and any other gear and drive arrangement known in the art may also be substituted. For example, the gear arrangement may comprise a continuous rotation pinion and ring gear combination employed with a solenoid-activated detent which stops the carousel on operator command.

Merchandising machine 10 also includes a refrigeration system which chills air that is recirculated and distributed throughout the interior of cabinet 12. By way of example and not limitation, such a refrigeration system may include an evaporative chiller and a blower (not illustrated) disposed in the base of cabinet 10 which forces chilled air up through central duct 23 of carousel 20. Central duct 23 is centered about vertical axis 22 and is defined by side walls 34. Slots ma be configured in side walls 34 such that as the air is forced up through central column 32, it flows out through the slots and over the products disposed in compartments 30. Air may be returned to the evaporative chiller via a return register disposed in the floor of cabinet 10. The particular configuration of the refrigeration system does not comprise a limiting feature of the present invention, and therefore, a detailed description of such a system is omitted. However, such a system is employed in the commercially-available Model No. 548 ShowCase TM merchandising machine manufactured and sold by Rowe International, Inc., of Whippany, N.J.

It is also typical in merchandising machines of the type to which the present invention is directed to have a microprocessor which acts as a controller to perform various functions in the machine. For instance, the above-referenced Model No. 548 ShowCase TM merchandising machine includes an Intel 80C196 type of microprocessor which performs numerous functions, for example, inventory tracking, tracking of money received in the machine, tracking of temperature and health control requirements, fault diagnosis for the various systems within the machine, etc. The present invention is directed to an improvement in such control systems. In particular, the present invention includes a control means for actuating the drive means to rotate the carousel in a predetermined increment and at a predetermined time interval to periodically change the particular columns of compartments aligned with the viewing area. The predetermined increment of rotation is selected independently of the number and location of compartments of the carousel which contain merchandise to be dispensed, and the predetermined time interval is selected such that the merchandise disposed in the compartments of the carousel is maintained at substantially the average temperature prevailing in the cabinet. As embodied herein, the control means comprises a microprocessor 50, illustrated schematically in FIG. 4, which may be disposed at any convenient location within cabinet 12.

In any refrigerated area, such as the interior of cabinet 12, there would normally be a temperature gradient from one location to the next within the refrigerated space. For example, the columns of compartments closest to the viewing area would normally be at a higher temperature than those columns located in that portion of the refrigerated space towards the rear of cabinet 12. This is due, in part, to the fact that as delivery doors 18*a*–18*k* are opened to retrieve products disposed in the machine, cold air escapes through the access door, thereby raising the temperature in the vicinity close to the doors. The area of the cabinet immediately adjacent the delivery doors 18*a*–18*k* would also be subject to air leakage around the seals of the doors. Additionally, that portion of the interior of cabinet 12 immediately adjacent the viewing area is exposed to heat radiating from lighting devices typically mounted near the windows 16 and doors 18 to illuminate the products in the machine. The location an amount of insulation in the cabinet also contributes to temperature gradients. Such temperature gradients in the interior of cabinet 12 result in the products disposed in the machine being subjected to temperatures either above or below the average temperature designed for the machine. That average temperature, for example 40° F., is typically selected in order to meet health regulations imposed by various regulatory authorities within the jurisdiction in which the machines are used. If the carousel remains in one position, thereby exposing products disposed in the compartments of the carousel to either a higher or lower temperature than the average design temperature, then the products may either spoil before their expiration date or may be damaged by frost.

In order to overcome this problem, the control system of the present invention rotates the carousel through a predetermined increment of rotation and at predetermined time intervals to periodically reposition products within the cabinet. This periodic rotation of products disposed within the carousel from one location to another will alternately expose the products to a higher and lower temperature in accordance with the temperature gradient existing within the cabinet. If the time period between each successive rotation of the carousel is selected to be short enough, the products will be maintained at approximately the average temperature of the cabinet, thereby reducing any spoilage of product.

The program logic of the control system of the present invention will be described with reference to the flow chart shown in FIG. 4. The logic is embedded within microprocessor 50 as illustratively shown, and the microprocessor is electronically connected to motor 42 by appropriate interface and drive devices. Microprocessor 50 is provided with program instructions comprising a main program schematically illustrated in FIG. 4 as block 52. The control logic of the present invention may be visualized as a subroutine of main program 52 and the steps of that subroutine, shown in FIG. 4, will be described below.

At step 100, a real-time clock is read, and at step 102 a start time is set equal to the real-time clock. At step 104 the real-time clock is again read, and at step 106 the delta time is set equal to the real-time clock. At step 108, the microprocessor determines whether the real time is within a preset portion of the day which is characterized as "business hours." This step permits the control system to suspend execution of the subroutine during non-business hours when there is not expected to be any customers vending from the machine. Of course, the business hours may be set to include the entire 24 hours within the day, or some portion of the day. However, if less than the entire day is designated as "business hours," the operator should check to insure that the merchandise disposed in the machine does not spoil by being subjected to warm and cold spots for too long during the designated non-business hours.

If the delta time is not within the business hours preset within the control logic, then the control system exits to the main program and no rotation of the carousel is commenced. However, if the delta time is within the preset business hours, then the control logic branches to step 110 where it is determined whether the delta time equals the start time plus a predetermined time interval which is illustrated, by way of example and not limitation, as being three minutes. This predetermined time interval may of course be set to something other than three minutes so long as the time interval is short enough to move the carousel so as to subject products disposed therein to various temperatures within the cabinet to thereby maintain those food products at the average cabinet temperature.

If the delta time does not equal the start time plus the predetermined time interval, then the control logic reverts back to step 104 and repeats the sequence described above. However, if the delta time equals the start time plus three minutes, then the control logic, at step 112, determines whether a vend has just occurred from the machine, i.e., within the past predetermined time interval. If a vend just occurred, then the logic branches to step 116 and the start time is set equal to the delta time and the logic is repeated beginning with step 104.

If no vend has just occurred, then the control logic determines, at step 114, whether a vend is in process. If no vend is in process, then at step 115 the carousel is rotated by a predetermined increment which, in the present preferred embodiment, comprises rotating the carousel via the motor means a distance equal to three columns of compartments which, in the present embodiment, equals 3/14 of a complete revolution. This has the effect of moving the products disposed within the carousel to a different position such that they are now subjected to the temperature prevailing at that particular position within the cabinet. After the carousel is rotated at step 115, the control logic advances to step 116 and the subroutine is repeated.

In the above-described control system, the predetermined increment through which the carousel is rotated may be increased or decreased when the carousel has been rotated through a number of increments which is a multiple of the number of columns of compartments in the carousel. This allows a large number of steps to be taken without the pattern repeating. For example, in the present preferred embodiment, there are seven full-size compartments on each shelf of the carousel which may be divided in half. Therefore, there are fourteen columns of compartments. The carousel therefore has fourteen possible stopping points in one complete revolution. One of the columns of compartments can be arbitrarily designated as column 1, and that column may be brought to the viewing area after the vendor is loaded and the doors closed. By sequencing the carrier during periods of inactivity by increments of three compartments, fourteen sets of sequences are possible before any sequence is repeated (14 times 3 is the first multiple of 3 evenly divisible by 14). In a practical application of the present invention, the predetermined increment through which the carousel is rotated should be limited so as to reduce wear on the mechanical components of the machine.

Figure 4:
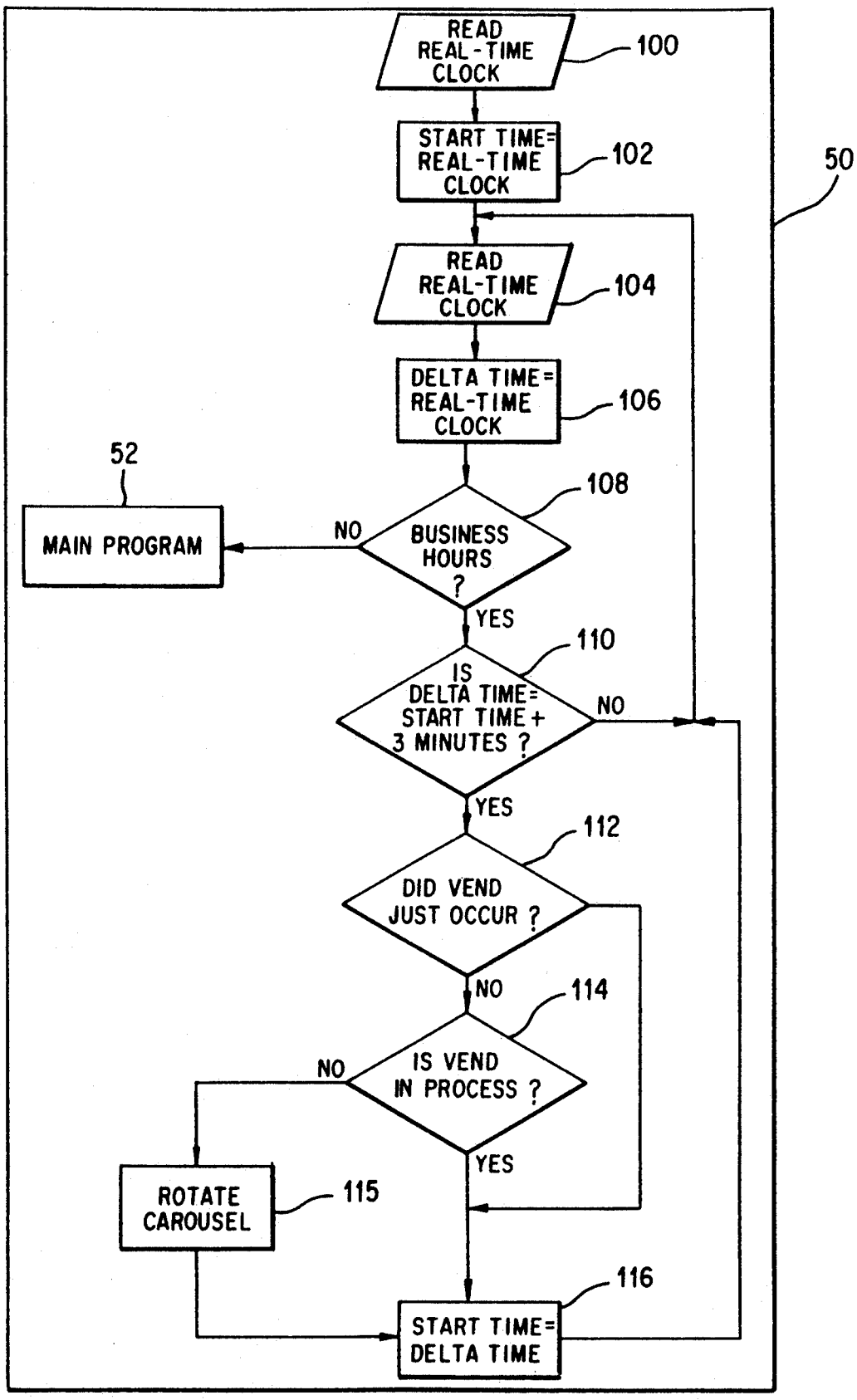
FIG. 4 is a flow chart illustrating the computer program logic of a preferred embodiment of the control system of the present invention.

If the predetermined time interval a which the carousel is rotated is selected to be three minutes as shown in FIG. 4, it would be one hour and thirty-four minutes before the same sequence results in the same columns of compartments being disposed immediately adjacent the viewing area. If that same time interval were extended to five minutes, the same column of compartments would not be positioned behind the viewing area for two hours and twenty minutes. Thus, the present invention also performs the function of periodically changing the display of products immediately adjacent the viewing area to thereby offer for sale and ever-changing variety of products from the machine.

Additional advantages and modifications to the preferred embodiment of the present invention described above will readily occur to those skilled in the art. Therefore, the invention in its broader aspects is not limited to the specific details, representative devices, and illustrative examples shown and described. Accordingly, departures may be made from such details without departing from the spirit or scope of the general inventive concept as defined by the appended claims and their equivalents.

What is claimed is:

1. A multipurpose, refrigerated merchandising machine, comprising:

a cabinet having a door defining a front surface of said cabinet, said door including a viewing area for viewing products disposed in the merchandising machine;

a merchandise carousel rotatably mounted in said cabinet about a vertical axis, said carousel including a plurality of shelves spaced along the vertical axis;

a plurality of dividers disposed on each of said shelves to define a plurality of compartments on each shelf for receiving merchandise to be dispensed, said dividers and said shelves, in conjunction, defining a plurality of vertical columns of compartments around the periphery of said carousel;

driving means for rotating said carousel to bring respective ones of said columns of compartments into alignment with said viewing area; and control means for actuating said drive means to rotate said carousel through a predetermined increment of rotation and at a predetermined time interval to periodically change the particular columns of compartments aligned with said viewing area, said predetermined time interval being selected such that the merchandise disposed in said compartments of said carousel are maintained at substantially the average temperature prevailing in the cabinet.

2. The display system of claim 1 wherein said predetermined increment is equal to a number of columns of compartments which is less than the total number of columns of compartments around the periphery of the carousel.

3. The display system of claim 2 wherein said control means further comprises means for alternatively increasing or decreasing said present number of columns of compartments to selectively change the predetermined increment.

4. The display system of claim 1 including means for deactivating said control means during predetermined time periods.

* * * * *